US011565218B2

(12) United States Patent
Leubner et al.

(10) Patent No.: US 11,565,218 B2
(45) Date of Patent: Jan. 31, 2023

(54) PRECISION STIRRERS AND MIXERS

(71) Applicants: Ingo H. Leubner, Penfield, NY (US); Stephen L. Galasso, Rochester, NY (US)

(72) Inventors: Ingo H. Leubner, Penfield, NY (US); Stephen L. Galasso, Rochester, NY (US)

( * ) Notice: Subject to any disclaimer, the term of this patent is extended or adjusted under 35 U.S.C. 154(b) by 0 days.

(21) Appl. No.: 16/018,021

(22) Filed: Jun. 25, 2018

(65) Prior Publication Data

US 2019/0118147 A1 Apr. 25, 2019

Related U.S. Application Data

(60) Provisional application No. 62/524,153, filed on Jun. 23, 2017.

(51) Int. Cl.
*B01F 7/00* (2006.01)

(52) U.S. Cl.
CPC ..... *B01F 7/00458* (2013.01); *B01F 7/00016* (2013.01); *B01F 7/00633* (2013.01); *B01F 2215/0404* (2013.01); *B01F 2215/0409* (2013.01); *B01F 2215/0422* (2013.01); *B01F 2215/0431* (2013.01)

(58) Field of Classification Search
CPC ..... B01F 7/00458; B01F 2215/0422; B01F 7/00016
See application file for complete search history.

(56) References Cited

U.S. PATENT DOCUMENTS 7,073,738 B2 * 7/2006 Sneeringer ..... B01F 7/00466 241/172
7,316,502 B2 * 1/2008 Freeman ..... B01F 7/00041 366/316

* cited by examiner

*Primary Examiner* — Elizabeth Insler
(74) *Attorney, Agent, or Firm* — Bassett IP Strategies; David F. Bassett

(57) ABSTRACT

The present invention provides for precision stirrers and mixers which are precision devices for the control of mixing and stirring in liquid and non-liquid systems. As will become obvious, the devices provided for in the present invention may be used for mixing or stirring by adjusting the device configurations and allow precise desired ingredient addition.

20 Claims, 16 Drawing Sheets

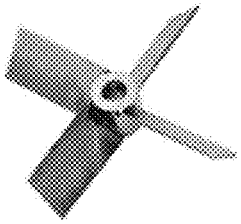
4 Blade Axial Impeller
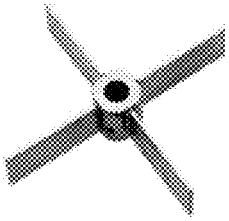
4 Blade Radial Impeller
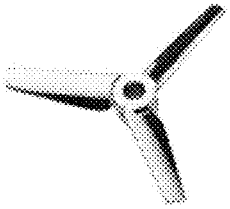
High Efficiency Hydrofoil Impeller
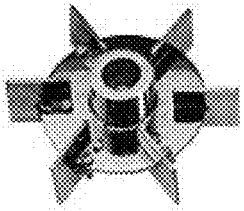
6 Blade Rushton Impeller
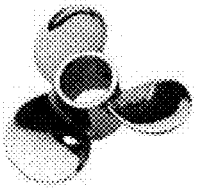
Sanitary Finish Propeller
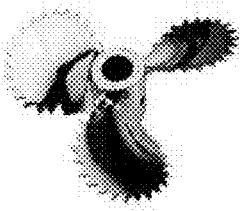
Saw Tooth Propeller
PRIOR ART
FIG. 1

| | | | | |
|---|---|---|---|---|
| The Pumping Rate (ex., liter/min) is a function of the stirring Disk | | | | |
| And the rate of rotations per minute (RPM) | | | | |
| The Pumping Efficiency of Disk-Architecture: | | | | |
| Disk material: Polyvinylchloride (PVC) was used for these Experiments | | | | |
| 0.5 cm | PVC-Thickness | | | |
| 6 | Channel/Hole number/disk | | | |
| 7.5 cm | Disk Diameter (6.0 inch) | | | |
| H-C | Radial Hole to Center Distance | | | |
| H-D | Hole-Diameter | | | |
| | | | | |
| **Test Samples** | **Stat-Design** | **H-C** | **H-D** | **Liter/min** |
| - | - | **cm** | **cm** | **(1,000 RPM)** |
| T1 | LL | 2.54 | 0.64 | 4.82 |
| T2 | LH | 2.54 | 1.28 | 8.51 |
| T3 | CL | 4.45 | 0.64 | 2.84 |
| T4 | CC | 4.45 | 0.95 | 5.78 |
| T5 | CH | 4.45 | 1.28 | 8.51 |
| T6 | HL | 6.35 | 0.64 | 6.52 |
| T7 | HH | 6.35 | 1.28 | 6.99 |
| T8 | HC | 4.45 | 0.8 | 5.20 |
| | | | | |
| L= | Low- level | | | |
| H= | Highest Level | | | |
| C= | Center Level | | | |

FIG. 15

PRECISION STIRRERS AND MIXERS

CROSS-REFERENCE TO RELATED PATENT APPLICATIONS

Priority for this patent application is based upon provisional patent application 62/524,153 (filed on Jun. 23, 2017). The disclosure of this United States patent application is hereby incorporated by reference into this specification.

BACKGROUND OF THE INVENTION

Traditional stirrers and mixers consist of a shaft which is driven by a motor with impellers or paddles of various designs attached to the shaft providing stirring and mixing actions. FIG. 1 shows a representative series of commercial designs of mixers, stirrers, and impellers currently available.

The mixing-efficiency of traditional stirrers and mixers is modeled by their pumping effect and by the dynamic response that the impeller imparts into the fluid. When an impeller rotates in the fluid, it generates a combination of flow and shear.

The flow rate produced (in gallons per minute, GPM) and the energy consumed (in horse power, HP) are defined by a characteristic Flow Number (FN) which is a function of the impeller design, impeller diameter (ID), and rotation rate (rotations per minute, RPM). Flow-Numbers, FN, for impellers have been published by the North American Mixing Forum.

It is frequently assumed that the energy imparted by the stirring or mixing device is a significant factor for the properties of the vessel content. The energy consumption (power draw, HP) is defined by the Power-Number (PN), rotation rate (RPM), the impeller diameter (ID), and the fluid specific gravity (FSGR). The impeller generated flow, GPM may be estimated by using the following equation (1)

$$GPM = \frac{(FN * RPM * ID^3)}{231} \tag{1}$$

wherein GPM is flow in gallons per minute,

FN is the flow number (dimensionless),

RPM is the impeller rotational rate in revolutions per minute,

ID is the impeller diameter in inches, 231 is conversion factor [cubic inches per gallon]

The power draw (in HP) on the mixing motor can be estimated as $$\mathrm{HP} = \frac{(PN * RPM^3 * ID^5 * FSGR)}{1.525 * 10^{13}} \tag{2}$$

Wherein HP is power in horsepower (hP),

PN is the power number (dimensionless),

RPM is the impeller rotational rate in revolutions per minute,

ID is the impeller diameter inches,

FSGR is the fluid specific gravity (dimensionless), $1.525*10^{13}$ is a conversion factor to horse power (dimensionless).

The estimated energy input (HP)—demand is useful for acquiring and installing appropriate stirrer motors.

The energy input, HP, by the impellers into the reaction mixture is frequently thought to be responsible for unexplained variations of product properties. In temperature-controlled systems, this energy is, of course, neutralized by temperature of the reactor content. Thus, under these conditions, the thermal energy input by stirrers may not contribute to product variability.

Traditional stirrer and mixer devices are generally used for both mixing and stirring. Beyond equations (1) and (2), little seems to be known about the connection between stirrer design, pumping rate (GPM) and energy consumption. As such, general design for scaling impellers for a process from bench-scale to industrial production is little understood. Popular stirrers are magnetic bars and 'marine propellers', however, because of their tendency towards laminar flow regimes, they generally provide poor mixing. Stirring can be related to the turn-over rate of the reaction mixture. In contrast, mixing is provided by controlled mixing rate of reactants with the reaction mixture, the reactor turn-over time, and the reactant reaction rate. Due to cavitation and other effects of mixing, the rate of mixing of ingredients and reactants in a mixture stirred by currently available stirrers such as a magnetic stir bar and mixed by currently available mixers such as those depicted in FIG. 1 cannot be precisely predicted and measured. This inability to precisely control reactant mixing can lead to suboptimal processing of certain chemical reactions such as those used to crystallize silver halides. It is yet another object of the present invention to greatly reduce cavitation within the mixer further allowing for precise prediction of flow rates within the mixer.

It is an object of the present invention to provide quantitative control parameters which allow the designer of a mixer or stirrer to predict the mixing and stirring properties of the mixers and stirrers of the present invention and to design the mixer or stirrer to optimally mix the desired ingredients. It is another object of the present invention to allow the designer or user of the mixers and stirrers of the present invention to accurately and optimally determine the required energy input for a particular degree of mixing. It is yet another object of the present invention to provide mixers and stirrers which allow precise addition of ingredients.

SUMMARY OF THE INVENTION

The precision stirrers and mixers of the present invention are precision devices for the control of mixing and stirring in liquid and non-liquid systems. As will become obvious, the devices provided for in the present invention may be used for mixing or stirring by adjusting the device configurations.

In the present specification, embodiments for three representative stirrer designs and a representative mixer design are presented. FIG. 2 depicts a standard (top to bottom) stirrer; FIG. 3 depicts an anti-standard (bottom to top) stirrer; FIG. 4 depicts a twain (two way) stirrer; and FIG. 5 depicts a mixer.

The three representative stirrer designs provide controlled circulation through reactors.

The representative mixer design consists of a combination of the standard and anti-standard stirrers. It provides controlled and intimate mixing of the reactor content with controlled addenda addition.

Stirrer: As depicted in FIGS. 2-4, a stirrer of the present invention consists of one or more parallel disks that pump in the same or opposite directions. This allows controlling the directional flow through a reactor. Three basic designs (top-to-bottom, bottom-to-top, and twain) provide controlled flow of the reactor into and through the reactor.

As depicted in FIG. 2, for the standard (top-to-bottom) stirrer, the reactor volume is pumped towards the bottom of the reactor. This design is advantageous for situations such as when a reactant is a low-density material relative to the reaction product as the low-density material may be pumped toward the bottom of the reactor and through the bulk reactor content.

As depicted in FIG. 3, for the anti-standard (bottom-to-top) stirrer, the reactor content is pumped from the reactor bottom towards the surface of the reactor content. This is advantageous for situations such as when material settles on the bottom, and for efficient mixing of the reactor content towards the surface of the reactor contents.

As depicted in FIG. 4, for the twain stirrer, the channels (holes) of the stirrer disks are arranged such that for the same stirring direction, one set of holes pumps bottom-to-top and the other set of holes pumps from top-to-bottom. Thus, this design enhances the mixing of the top and bottom layers of the reactor content.

Mixer: As depicted in FIGS. 5 and 6, a mixer consists of two or more disks that are spaced parallel to each other at pre-determined distances (which may be referred to as gaps) on a central shaft. In FIG. 5, the schematic for the stirrer parts are shown and in FIG. 6, the assembled mixer is shown. The central shaft is preferably driven by a controllable power source such as a controllable motor. The disks preferably have defined sizes and quantities of channels that are located at defined distances from the central shaft. The channels of the upper and lower disk are preferentially arranged for pumping the reactor content into the gap between the disks. The shape of the channels is preferentially circular. As those skilled in the art are aware, other shapes, for example quadratic, rectangular, triangular, oval, and the like may be chosen without deviating from the teachings of the present invention.

The channels are preferably drilled through the disks at pre-determined angles relative to the disk surface. Further, the channels are arranged such that their openings are directed into the rotation direction. The drill-channel direction may be varied relative to the disk axial direction. Scoop-feeding type channels may be added by various means well known in the art such as controlled hole-drilling or by insertion of designed tubing into the disk-channels or the like.

The mixer is preferably designed such that the reactor content is pumped with pre-determined flow rates. This quantitatively provides controlled mixing of reactor content with defined controlled added reactant and other solutions or other materials. Controlled addition of reactant solutions to reactor content is achieved by adding the materials to the channel openings at the surfaces or bottom of the mixer.

As will be described, the control of the flow of the reaction between the mixer disks is achieved by disk-design and the disk rotation rate. Controlled dilution and mixing is achieved within the gap between the disks. The mixed solutions are ejected from the gap due to the centrifugal forces created by the rotation of the disks and by the flow through the holes.

Traditional mixing and stirring control is achieved by controlling impeller rotation rates. For the present invention the mixers and stirrers, in addition, have precisely designed holes through the stirrer disks. Thus, these mixers and stirrers provide additional opportunity for precisely controlling their pumping rates. The hole quantities and locations may be altered to increase or decrease mixer stirring efficiency, as required for the particular circumstances of the particular desired reactor, the reaction content, and action. The ability to alter the mixer or stirring efficiency allows for varying amounts of shear to be applied to the reactants and reaction products. This may allow for precise expression of physical properties of the reaction products. The precisely measured holes of the present invention allow for greater flow control, and therefore control of the rate of mixing, than is achievable with the stirrers and mixers of the current art.

An additional embodiment of the stirrers of the present invention will also include a cone fitted around the central shaft upstream of the flow of material towards the stirrer disk which essentially eliminates cavitation through the stirrer increasing the precision of the material flow through the stirrer.

The mixers and stirrers of the present invention are easily cleanable and sterilizable.

Mathematical Models

Mathematical models were developed applying to both mixers and stirrers of the present invention. As will become obvious to those skilled in the art, for otherwise equal design of the disks, the mixer, due to the presence of two active disks, provides twice the pumping rate relative to stirrers comprising a single disk of the same design. The modeling of the mixers and stirrers of the present invention provides predictive stirring and mixing as a function of the channel location, diameter, and quantity. The models also include the channel-properties through the stirrer disks, their distance from the center of the disks, channel angles and directions, and the viscosity of the reaction volume among, other variables.

Applicant respectfully points out that the models are presented to demonstrate the flow rates that will be realized via the stirrers and mixers of the present invention. The volumetric flow curve for the stirrers and mixers of the present invention is a linear function of the rotation rate which provides for precise flow through each disk of the stirrer and mixer.

BRIEF DESCRIPTION OF THE FIGURES

FIG. 1 depicts representative examples of stirrers, mixers, of the present art.

FIGS. 11-15 depict pumping rates of preferred stirrers of the present invention.

DETAILED DESCRIPTION OF THE INVENTION

In the specification described below several equations will be presented. Table 1 provides a listing of the variables used in the equations and the units of measure in System International measuring system units (mks, cgs), and other standard units. Table 2 lists the output of the calculations.

TABLE 1

Table 1: Design Parameters for Modeling Input Variables

| | |
|---|---|
| $C_{in}$ | Reactant concentration in inlet |
| $C_{out}$ | Reactant concentration in outlet |
| $D_D$ | Disk-diameter (centimeters (cm)) |
| F | Force (Watt, horsepower) |
| $Q_H$ | Pumping Rate of Disk ($cm^3$/min) |
| $Q_R$ | Flow-Rate at Mixer Rim (cm/min) |
| R | Distance from disk center (cm) |
| $R_D$ | Disk-radius (cm) |
| $T_D$ | Disk-Thickness (cm) |
| $R_h$ | Distance of channel-center from disk-center (cm) |
| $r_h$ | Radius of channels (cm) |
| $n_i$ | Number of channels (mixer: top plus bottom disk) (dimensionless) |
| $n_s$ | Number of channels (single disk stirrer) (dimensionless) |
| $n_t$ | Number of channels (top disk) (dimensionless) |
| $n_b$ | Number of channels (bottom disk) (dimensionless) |
| H | Space thickness between disks (cm) |
| N | Rotations per time interval (rotations per second/minutes (RPS/RPM) |
| $S_D$ | Shaft diameter (cm) |
| $V_R$ | Reactor-content volume (cubic centimeters ($cm^3$ or ltr) |
| $V_S$ | Stirrer pumping-volume |
| A | Vertical channel-angle (into disk) |
| B | Horizontal channel-angle (parallel to disk) |
| H | Reactor content viscosity |
| $\eta_R$ | Viscosity normalized to Water Viscosity |
| rho | Density, g/$cm^3$, or kg/$m^3$ |
| tau | Time/rotation; turn-over time of reactor-content (min) |

TABLE 2

Table 2: Output Variables

| | |
|---|---|
| $Q_h$ | Flow Rate per channel, cubic centimeter/minute ($cm^3$/min) |
| $Q_H$ | Flow Rate/Disk ($cm^3$/min) |
| $Q_S$ | Total Flow Rate of Stirrer |
| $Q_M$ | Total Flow Rate of Mixer ($cm^3$/min) |
| Watt/Horsepower | Energy Consumption, kilowatt (kW)) |
| F | Vertical Force/Thrust |
| $Q_R$ | Rim flow-rate (cm/min) |

Precision Stirrers

Figure 2:
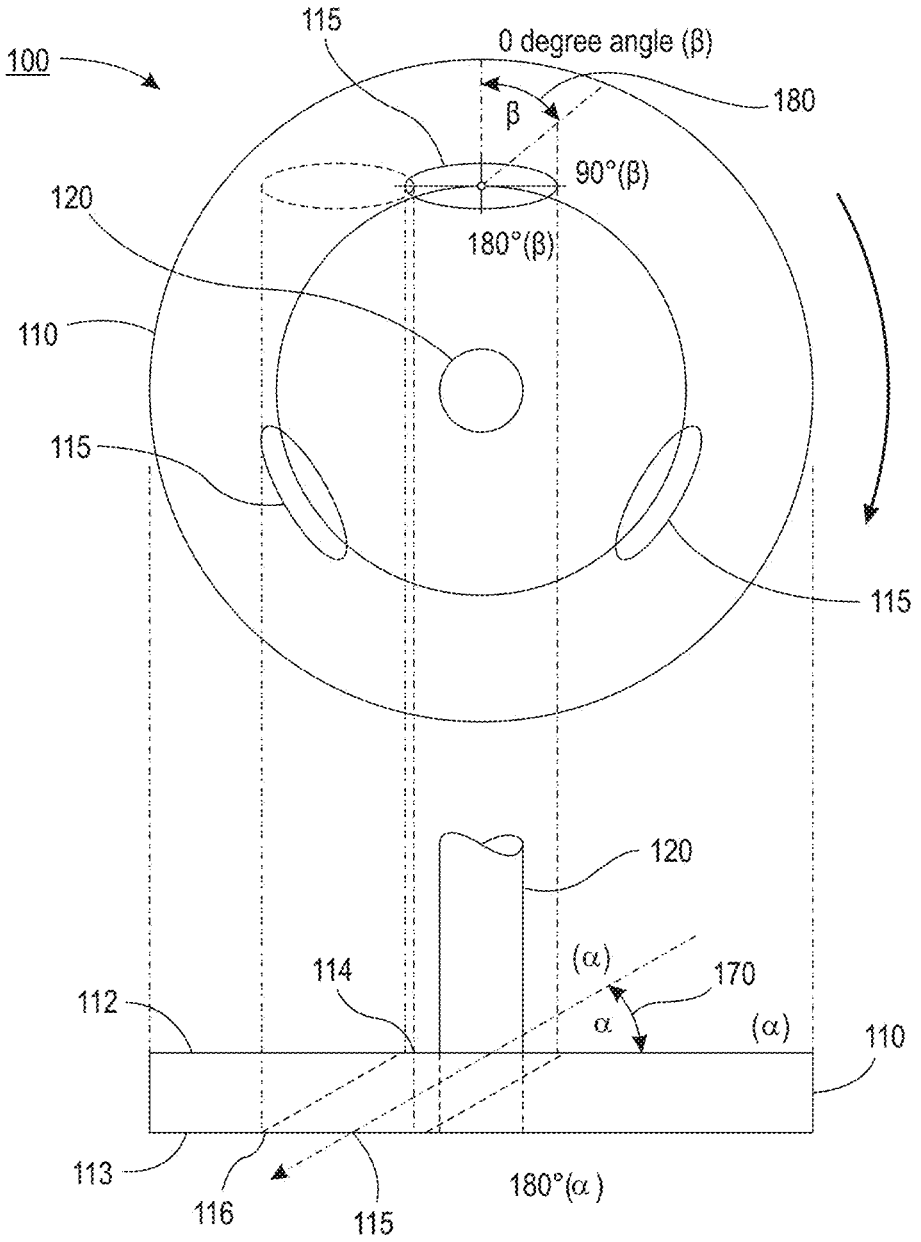
FIG. 2 depicts both a top view and a profile cross section view of a representative example of a standard stirrer of the present invention.

Referring to FIG. 2, a preferred embodiment of a standard one-disk stirrer 100 of the present invention is depicted for clock-wise rotation wherein clockwise is relative to and determined by looking down at the stirrer from above. The operational parameters of the one-disk stirrer 100 may be used to provide an understanding of additional embodiments of the stirrer of the present invention which incorporate additional stirrers. Depicted is a single disk 110 and a central shaft 120. The disk 110 is preferentially made of a polymer such as polyvinyl chloride (PVC), polyvinyl dichloride (CPVC), tetrafluoroethylene fluorocarbon polymers, and the like. The disk 110 may also be made of a metal or ceramic coated with previously mentioned polymers. Those skilled in the art readily know of several means to apply a polymeric coating on a metal or ceramic. The disk 110 may also be made of other non-porous materials such as stainless steel, acrylic, fiber glass, and the like. The central shaft 120 is preferentially made of a rigid material such as stainless steel, tantalum, or platinum. The central shaft 120 may also be made of a rigid material which is then coated with previously mentioned polymers. Those skilled in the art readily know of several means to apply a polymeric coating on a metal. The central shaft 120 may also be made of rigid materials such as PVC, Delrin™, and the like. In the preferred embodiment depicted in FIG. 2, the central shaft 120 is comprised of stainless steel threaded rod with a diameter is 0.953 centimeters (0.375 inches) though as should be readily apparent the shaft diameter does not affect flow rate through the stirrer. For an embodiment of the present invention wherein the central shaft may be acrylic threaded rod a shaft diameter of about 1.270 centimeters (0.500 inches) would be an appropriate size to pair with a 15.240 centimeter (6.000 inch) disk. Though the shaft is preferably a circular rod, other shaft geometries may be used without avoiding the teaching of the present invention. The power to rotate the central shaft 120 may be provided via any readily available controllable means; a preferred method to power the central shaft 120 is via a controllable power source such as a controllable motor. In a preferred embodiment the controllable motor is a direct current (DC) motor. In another preferred embodiment the controllable motor is an alternating current (AC) motor receiving a fixed electric current such that the motor rotational speed is held constant and the motor is connected to the central shaft 120 via a geared belt and pulley system whereby the rotational speed of the shaft 120 can be precisely controlled. Such geared belt and pulley systems are well known to those skilled in the art. The disk 110 may be attached to the shaft 120 using readily available means such that the disk 110 rotates at the same rotational velocity as the shaft 120. In a preferred embodiment, the shaft 120 is threaded and the disk 110 has a central threaded channel cut through the disk 110 such that the disk 110 can be threaded onto the shaft 120. There are several readily available means to lock the disk 110 into position on the shaft 120 including nuts and lock washers, lock bearings, keys and keyways, and the like. In one preferred embodiment, the means to secure the disk 110 to the shaft 120 is via a threaded stainless steel nut (not depicted). The disk 110 has a series of channels 115 each cut through the disk 110. The rotation of the disk 110 about the shaft 120 and the dimensions (size and angles) of each channel 115 are chosen to produce the desired flow rate of material into the bulk of the medium. In the preferred embodiment depicted in FIG. 2 the disk 110 has three channels 115 cut through the disk 110. In the preferred embodiment depicted in FIG. 2, the disk diameter is 15.240 centimeters (6.000 inches) and the disk thickness is 1.270 centimeters (0.500 inches). It will be readily apparent to those skilled in the art that the methods taught with the present invention will work with a wide array of disk sizes. For typical bench scale stirring with standard laboratory glassware, the disk diameter would typically be approximately 1½ inches with a thickness of 0.25 inches. 2 inch, 4 inch, and 8 inch diameter disks with a thickness of 0.5 inch each may be preferable for pilot operation. As will be described herewith the flow through the stirrer will vary linearly with the channel volume. So larger disks would be appropriate for full scale commercial operations and the disks could be produced on a nanoscale for in-line medical applications. Variations in channel geometry and their effects on flowrates will be described presently.

The operational parameters of the one-disk stirrer 110 are included to provide an understanding of additional embodiments of the stirrer which incorporate additional stirrers. Depicted in FIG. 2 is a single disk 110 and a central shaft 120. The disk 110 has a series of channels 115 each cut through the disk 110. Each channel 115 will have a leading edge 114 (opening through the disk surface) and a trailing edge 116 (opening through the disk surface). The rotation of the disk 110 by the shaft 120 and the dimensions (size and angles) of the channels 115 are chosen to calculate the anticipated pumping rates of the disks. Variations in channel geometry and their effects on flowrates are considered. For the stirrer presented in the representative example of FIG. 2, channel diameters are each 1.430 centimeters (0.563 inches). Other channel geometries may be employed as per the particular stirring application requirements without deviating from the teaching of the present invention. Pumping rates of mixers and stirrers may be varied on demand by selectively plugging selected channels and opening plugged channels, and adding more channels. Channels may also be fitted with a catalytic plug or a catalytic threaded screwed insert as will be described herewith. The channels 115 may be plugged via readily available means such as inserting stoppers made of rubber, nitrile, Teflon™ and the like. In the preferred embodiments of the present invention depicted in this specification, the channels are depicted as round or elliptical. It would be readily apparent to those skilled in the art that additional channel geometries such as elongated slats would also work with the present invention provided the channel dimensions are known.

Standard Precision Stirrer ('SS' Design 1):

Referring again to stirrer 100 depicted in FIG. 2 and viewing the stirrer 100 from above, with a clockwise rotation the disk 110 rotation directs medium above the disk 110 to pump through the channels 115 into the bulk material below the disk 110. The channels 115 are cut through the disk at an angle such that the leading edge 114 of the channel 115 is located on the disk upper surface 112 and the trailing edge 116 is located on the disk lower surface 113. The flow of material through the disk can be made such that material above the disk passes though and below the disk and material below the disk passes through and above the disk by selectively reversing the direction some channels which are cut through the disk such that the leading edge of a particular channel is located on the disk lower surface and the trailing edge of that particular channel is located on the disk upper surface. This design is useful for situations where the material does not tend towards the bulk of the medium, for example, if material is added from the top or for material that has a lower specific gravity than the bulk of the medium which causes the material to tend to float in the medium. These materials are directed to the bulk of the medium by the stirrer.

By altering the spin direction of the stirrer to counter-clockwise rather than clockwise, the pumping direction of material through the disk is reversed. This change causes the system to pump material initially located below the disk to flow through the channels and into the bulk medium located above the disk.

Figure 3:
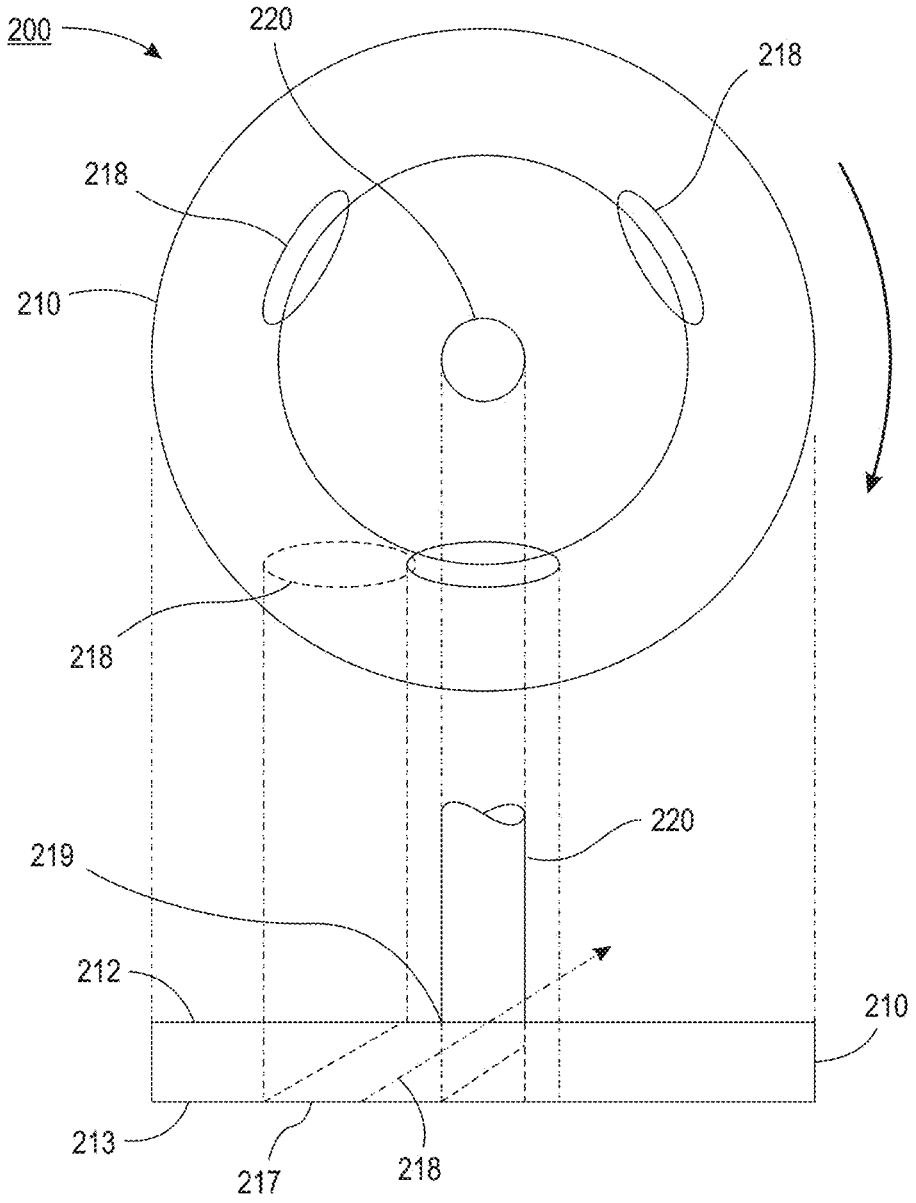
FIG. 3 depicts both a top view and a profile cross section view of a representative example of an anti-stirrer of the present invention.

Referring to FIG. 3 a preferred embodiment of a standard one-disk anti-stirrer 200 of the present invention is depicted for clock-wise rotation. The operational parameters of the one-disk stirrer 200 may be used to provide an understanding of additional embodiments of the stirrer of the present invention which incorporate additional stirrers. Depicted is a single disk 210 and a central shaft 220. The disk 210 is preferentially made of a polymer such as polyvinyl chloride (PVC), polyvinyl dichloride (CPVC), tetrafluoroethylene fluorocarbon polymers, and the like. The disk 210 may also be made of other non-porous materials such as stainless steel, acrylic, fiber glass, and the like. The central shaft 220 is preferentially made of a rigid material such as stainless steel. The central shaft 220 may also be made of rigid materials such as PVC, Delrin™, and the like. The power to rotate the central shaft 220 may be provided via any readily available controllable means; a preferred method to power the central shaft 220 is via a controllable power source such as a controllable motor. The disk 210 is attached to the shaft 220 using readily available means such that the disk 210 rotates at the same rotational velocity as the shaft 220. In a preferred embodiment, the shaft 220 is threaded and the disk 210 has a central threaded channel cut through the disk 210 such that the disk 210 can be threaded onto the shaft 220. There are several readily available means to lock the disk 210 into position on the shaft 220 including nuts and lock washers, lock bearings, keys and keyways, and the like. In one preferred embodiment, the means to secure the disk 210 to the shaft 220 is via a threaded stainless steel nut (not depicted). The disk 210 has a series of channels 218 each cut through the disk 210. Each channel 218 will have a leading edge 217 (opening through the disk surface) and a trailing edge 219 (opening through the disk surface). The rotation of the disk 210 about the shaft 220 and the dimensions (size and angles) of each channel 218 are chosen to produce the desired flow rate of material into the bulk of the medium. The channels 218 are cut through the disk 210 at an angle such that the leading edge 217 of the channel 218 is located on the disk lower surface 213 and the trailing edge 219 is located on the disk upper surface 212. Variations in channel geometry and their effects on flowrates will be described further.

Figure 4:
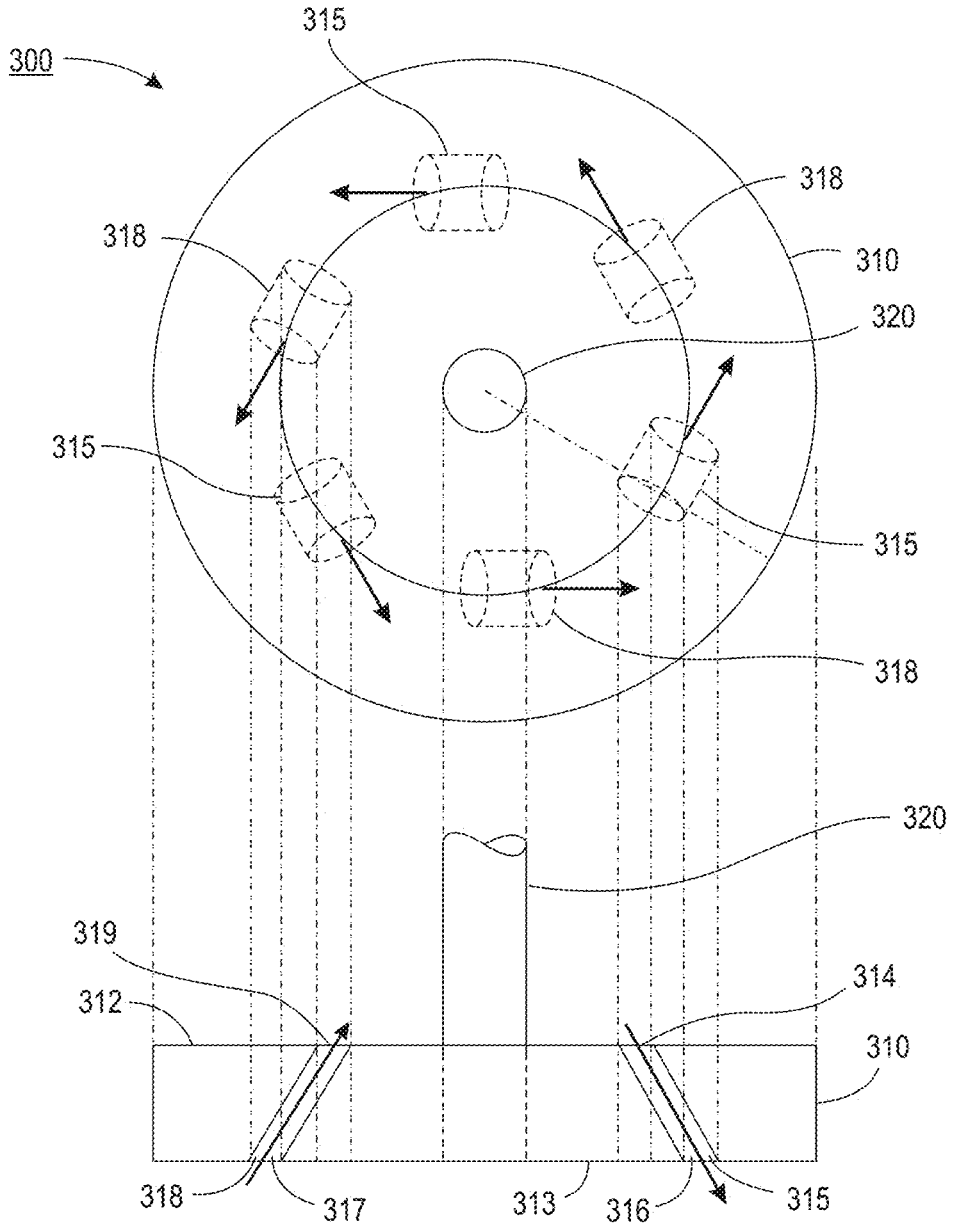
FIG. 4 depicts both a top view and a profile cross section view of a representative example of a twain stirrer of the present invention.

Referring to FIG. 4 a preferred embodiment of a standard one-disk twain-stirrer 300 of the present invention is depicted for clock-wise rotation. The operational parameters of the one-disk stirrer 300 may be used to provide an understanding of additional embodiments of the stirrer of the present invention which incorporate additional stirrers. Depicted is a single disk 310 and a central shaft 320. The disk 310 is preferentially made of a polymer such as polyvinyl chloride (PVC), polyvinyl dichloride (CPVC), and the like. The disk 310 may also be made of other non-porous materials such as stainless steel, acrylic, fiber glass, and the like. The central shaft 320 is preferentially made of a rigid material such as stainless steel. The central shaft 320 may also be made of rigid materials such as PVC, Delrin™, and the like. The power to rotate the central shaft 320 may be provided via any readily available controllable means; a preferred method to power the central shaft 320 is via a controllable power source such as a controllable motor. The disk 310 is attached to the shaft 320 using readily available means such that the disk rotates at the same rotational velocity as the shaft. In a preferred embodiment, the shaft 320 is threaded and the disk 310 has a central threaded channel cut through the disk 310 such that the disk 310 can be threaded onto the shaft 320. There are several readily available means to lock the disk 310 into position on the shaft including nuts and lock washers, lock bearings, keys and keyways, and the like. In one preferred embodiment, the means to secure the disk 310 to the shaft 320 is via a threaded stainless steel nut (not depicted). The disk 310 has a series of channels 315, 318 each cut through the disk 310. The rotation of the disk 310 about the shaft 320 and the dimensions (size and angles) of each channel 315, 318 are chosen to produce the desired flow rate of material into the bulk of the medium. In the preferred embodiment depicted, each channel 315 is cut through the disk at an angle such that the leading edge 314 of the channel 315 is located on the disk upper surface 312 and the trailing edge 316 is located on the disk lower surface 313. Also, in the preferred embodiment depicted, each channel 318 is cut through the disk 310 at an angle such that the leading edge 317 of the channel 318 is located on the disk lower surface 313 and the trailing edge 316 is located on the disk upper surface 312. Variations in channel geometry and their effects on flowrates will be described further.

Stirrer Pumping Rates

Referring again to the preferred embodiment of the present invention depicted in FIG. 2, the pumping rate of the disk is a function of several parameters which will be described more fully below. The flow rate ($v_R$) of material through an individual circular channel (with a radius, r; and radial distance from the central shaft, R) which is cut tangential through the disk at an (α)-angle, is given by equation (3). $C_A$ is the efficiency constant dependent on the (α) and (β)-angles (0 to 1.0), and N is the disk rotation rate.

$$V_R = \frac{2\pi R}{\tau} = C_A * 2\pi R * N \text{[cm/sec]} \tag{3}$$

The volumetric flow rate ($Q_h$) of material through an individual channel is given by equation 4

$$Q_h = C_A * V_R * 2\pi * r^2 * N = C_A * 4\pi^2 r^2 * R * N \text{ [cm}^3\text{/min]} \tag{4}$$

For equations (3) and (4), a material viscosity ($\eta_R$) equal to 1.0 was assumed. If the viscosity of the reactor content is different of 1.0, the volumetric flow rate ($Q_H$) is given by equation 5:

$$Q_H = \frac{Q_h}{\eta_R} \tag{5}$$

The total pumping rate (Q) of fluid through the stirrer-disc is a function of the quantity of channels, $n_s$, cut through the disc. When all disc-channels are identical, the total pumping rate is given by equation (6):

$$Q_s = n_s * Q_H = n_s * C_A * 4\pi^2 r^2 r^2 * R * N \text{ [cm}^3\text{/min]} \tag{6}$$

For the case when the channels are not identical, the total pumping rate is the sum of the individual channels, n, $Q_i$ (equation (7), i=1–n)

$$Q_s = \text{sum}(Q_1 + Q_2 + \ldots + Q_n) \tag{7}$$

Mixer Pumping Rates

For mixers, the total pumping rate is given by the sum of the individual disks. For disks that have the same number of channels, $n_m$ with equal geometry, the total pumping rate is given by equation (8):

$$Q_M = 2 * n_s * Q_H = 2 * n_s * C_A * 4\pi^2 r^2 * R * N \text{ [cm}^3\text{/min]} \tag{8}$$

For mixers with individual channels, the overall-pumping rate, $Q_{MI}$, is given by the sum of the variety of $n_{HI}$, identical channels, with identical pumping rates $Q_{Hi}$ (equation (4))

$$Q_{MI} = \sum_{n=1}^{n_i} n_{HI} Q_{HI} \text{[cm}^3\text{/min]} \tag{9}$$

Reactor Turn-Over Rate

The time for pumping the total reaction volume, $V_s$, with one stirrer one time through the reactor is defined as turn-over time or rate, referred to as τ ('tau', min). It is known to those familiar with stirring and mixing procedures that the turn-over rate is an important reactor parameter.

For stirrers of the current invention, the turn-over time (min) is defined by equation (10)

$$\tau_M = \frac{V_s}{Q_s} \tag{10}$$

For mixers of the current invention, the turn-over time (min) is defined by equation (11)

$$\tau_M = \frac{V_s}{Q_M} \tag{11}$$

Mixer: Disk-Rim Flow-Rate

Figure 5:
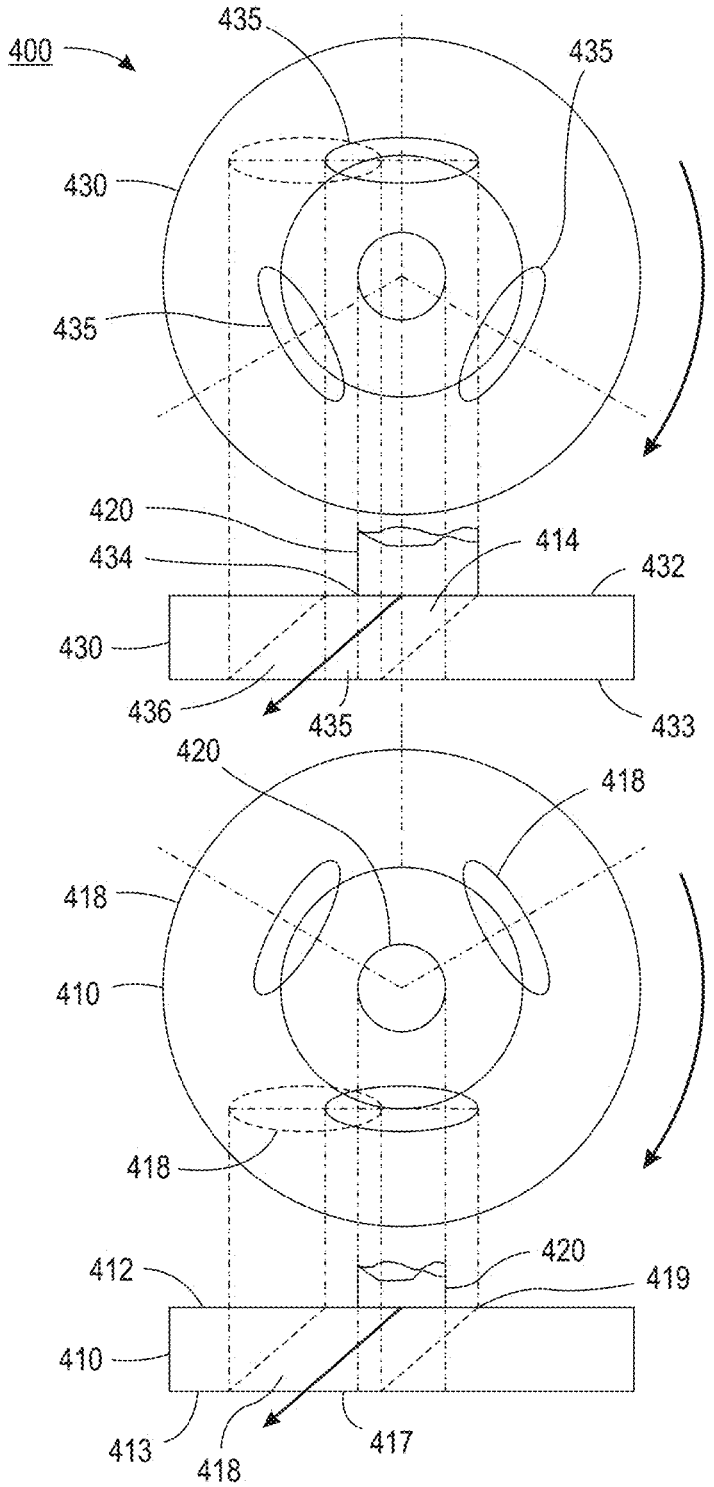
FIG. 5 depicts both a top view and a profile cross section view of a representative example of a mixer of the present invention.
Figure 6:
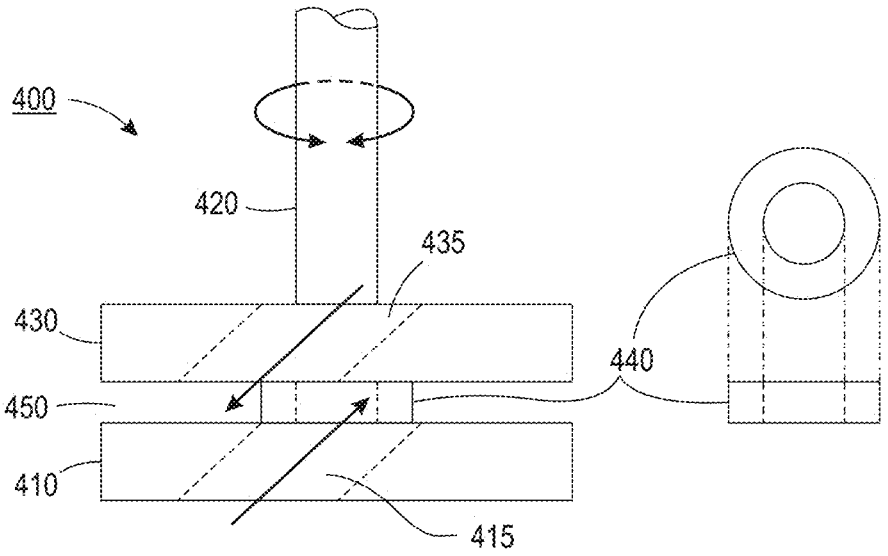
FIG. 6 depicts both a top view and a profile cross section view of a preferred embodiment of a mixer of the present invention.

Referring to the mixer 400 depicted in FIGS. 5 and 6, the materials of construction of the mixer 400 and the methods of construction and attachment of the mixer 400 are preferentially the same as those used in the construction of the stirrers depicted in FIGS. 2, 3, and 4. Depicted in FIGS. 5 and 6 are a lower disk 410, an upper disk 430, a central shaft 420, and a spacer 440. The spacer maintains a preferred disk spacing 450 to allow for a constant reactor volume between the two disks. It should be readily apparent to those skilled in the art that additional reactor spaces could be created by incorporating additional disks in the mixer but for simplicity and clarity as single reactor volume mixer is described presently. In the preferred embodiment depicted in FIGS. 5 and 6, the central shaft 420 is comprised of stainless steel threaded rod with a diameter is 0.953 centimeters (0.375 inches) though as should be readily apparent the shaft diameter does not affect flow rate through the stirrer. For an embodiment of the present invention wherein the central shaft may be acrylic threaded rod a shaft diameter of about 1.270 centimeters (0.500 inches) would be an appropriate size to pair with a 15.240 centimeter (6.000 inch) disk. Though the shaft is preferably a circular rod, other shaft geometries may be used without avoiding the teaching of the present invention. The disks 410, 430 are attached to the shaft 420 using readily available means such that the disk rotates at the same rotational velocity as the shaft. In a preferred embodiment, the shaft 420 is threaded and the disks 410, 430 each have a central threaded channel cut through the disk 410, 430 such that the disk 410, 430 can be threaded onto the shaft 420. There are several readily available means to lock the disks 410, 430 into position on the shaft including nuts and lock washers, lock bearings, keys and keyways, and the like. In one preferred embodiment, the means to secure the disks 410, 430 to the shaft 420 is via a threaded stainless steel nut (not depicted). The lower disk 410 has a series of channels 418 each cut through the disk 410. Each channel 418 will have a leading edge 417 (opening through the disk surface) and a trailing edge 419 (opening through the disk surface). The channels 418 are cut through the disk 410 at an angle such that the leading edge 417 of the channel 418 is located on the disk lower surface 413 and the trailing edge 419 is located on the disk upper surface 412. The upper disk 430 has a series of channels 435 each cut through the disk 430. The channels 435 are cut through the disk at an angle such that the leading edge 434 of the channel 435 is located on the disk upper surface 432 and the trailing edge 436 is located on the disk lower surface 433.

To ensure that the disks remain situated parallel to each other, the disks may need to be dynamically balanced by adding a small weight along one or more of the disks of the mixer further out from the center of the disk than the holes are located. This would only become an issue at high rotational speed (those in excess of 2,000 revolutions per minute). The art of dynamically balancing a rotating disk is well known and is not considered to be a novel feature.

Referring again to FIGS. 5 and 6, the mass-flow rate at the rim of the mixer 400, $Q_R$, provides an indication for the turbulent interaction between the reaction mass, the 'feed' from the mixer, $Q_M$ and the distance between disc-shaft 420 and inner wall of the reactor. It is defined by the Mixer total flow rate, $Q_M$. The flow rate at the rim, $Q_R$, is thus controlled by $Q_M$, the disk-spacing 450, h, and the disk radius, $R_D$ (equation (12)).

$$Q_R = \frac{Q_M}{6.283 * R_D * h}\left[\frac{\text{cm}}{\text{min}}\right] \tag{12}$$

The radial and rotational Rim flow rates are components of the formation of vortexes during mixing or the reactor content.

Reverse Modeling

Sometimes, reactor size, and pumping requirements for disks ($Q_s$) and mixers ($Q_M$) may call for changes of the adjustments of the disk size and channel-properties. To achieve these goals, the channel-size and the center-channel distance can be optimized. For reverse modeling, the flow-rate model for the standard-stirrer (equation (6) and (8)) will be used. The dimensions of the disk do limit the reactor efficiency. Thus, the channel to disk-center distance, $R_h$ is limited to $<R_D$, of the disk-radius. $R_h$, limits the size of the channel-radius, $r_h$. These limit the variables $Q_s$, and $n_s$. These equations provide the information to accommodate the size limitations of a given reactor system.

From equation (6), an intermediate variable, $H_D$, can be derived (equation 13). A reference value of $Q_s$ can be obtained from aim data for the reaction.

$$H_D = \left[\frac{1.0}{n_s * C_A * 4\pi^2 *} * \frac{Q_s}{N}\right] = [r_h^2 * R_h] \tag{13}$$

The value for $H_D$ can be determined from a reference precipitation, where the channel-center distance, $R_h$, and the channel-radius, $r_h$, are known. The value of ($Q_s$/N) can be determined from independent measurements. Further, the value of $C_A$ can be determined.

If $R_h$ is set, the matching value of $r_h$ can be calculated by (equation (14)).

$$r_h = \sqrt{H_D/R_h} \tag{14}$$

Alternatively, if limits are defined for $r_h$, values for $R_h$ can be calculated using (equation 15):

$$R_h = H_D/r^2 \tag{15}$$

this information provides added flexibility for the design of stirrers and mixers.

Alpha and Beta Angle Variations

Figure 7:
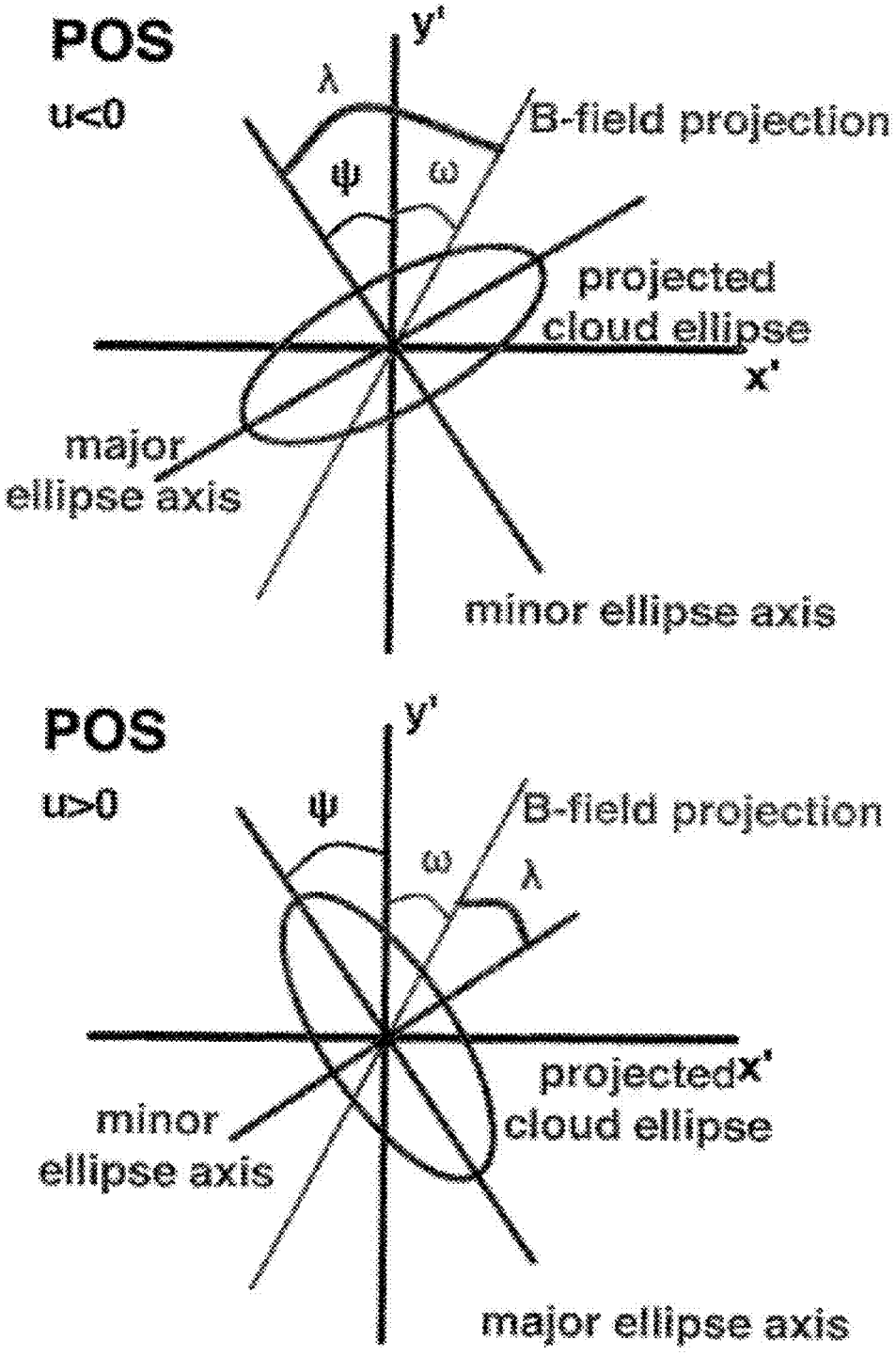
FIGS. 7 and 8 depict angles of incidence for various alpha and beta channel penetration angles of the present invention.
Figure 8:
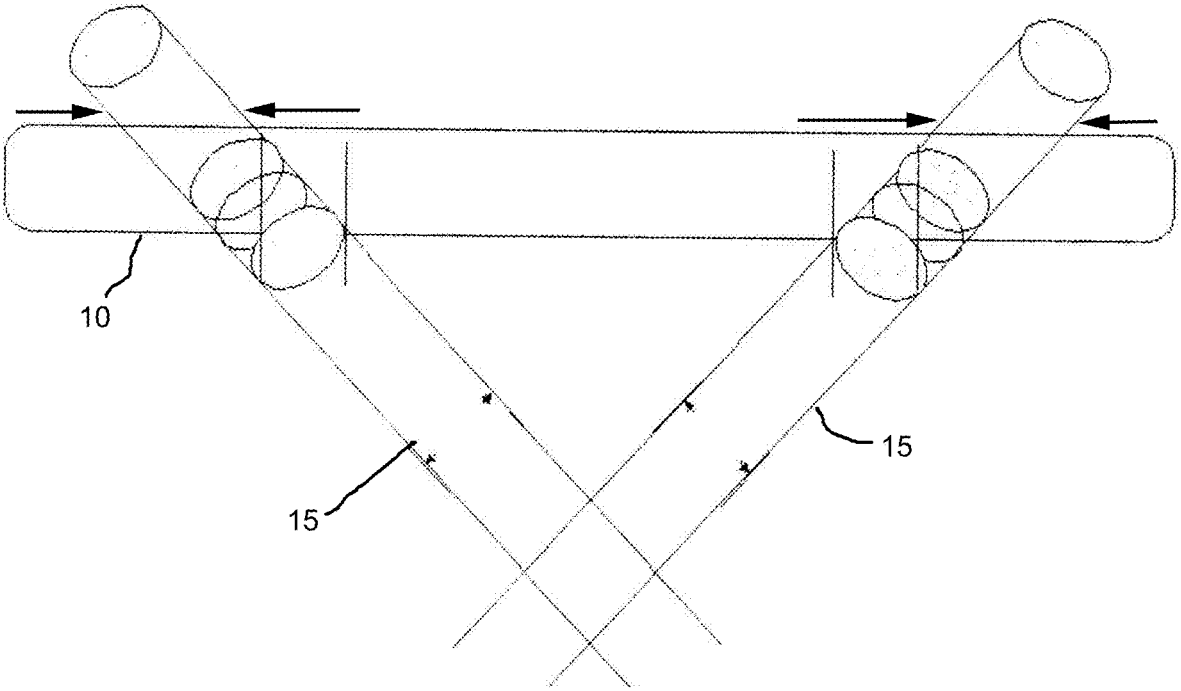

The efficiency of pumping, in addition to the variables discussed, is also a function of the drill-angles of the channels. Referring again to FIG. 2, and the stirrer 100 depicted therein, two angles are defined one as 'alpha' 170 and the other as 'beta' 180. The alpha angle is measured between a ray on the plane of the surface of the disk and a second ray along the channel penetration through the disk. As depicted in FIG. 2, a channel through the disk at an α-angle of 90 degrees would be perpendicular to the surface of the disk and a channel cut into the disk at an α-angle of zero degrees would run along the surface of the disk. The channels 115 depicted in FIG. 2 have an α-angle of about 45 degrees. The beta angle is measured on the surface of the disk as the angle between a ray along the tangent at a particular distance from the center of the disk and a ray along the channel penetration projection upon the surface of the disk. As also depicted in FIG. 2, a channel through the disk at a beta angle of zero degrees would be parallel to the radius of the disk and a channel cut into the disk at a beta angle of 90 degrees would run perpendicular to the radius of the disk. Another view of the alpha and beta angles is presented in FIG. 7. Referring to FIG. 8, the diameter of a pair of channels 15 each shaped like an ellipse is depicted as having been tapped through a disk 10.

A model has been developed, which allows pre-determining if channel will traverse the entire disk thickness or if the end of the channel is exiting at the side of the disk. The critical angle where the channel penetrates the side of the disk is determined by model calculations. The alpha angle must be greater than the critical angle and the beta angle must be smaller than the critical angle.

Alpha-Angle Model

For modeling, the α channel-angle is defined as being along the chord parallel to the tangent at the end of the channel-center line. The channel (hole) originates at the disk upper surface and ends at the disk lower surface. For general use of a stirrer or mixer, the lower end of the channel is preferred to terminate at the disk plane below the entry-plane.

The α-angle of the channel is defined by the drill-angle from the disk-surface to the disk bottom surface. To optimize the pumping rate of the channels, this channel is drilled perpendicularly relative to the line from the disk-center to channel-center.

Alpha-Angle and Disk Thickness

The angle of the alpha-channel determines the direction of the flow and the location of the flow-exit at the bottom the disk. Too low an alpha-angle may lead to the flow-exit through the rim of the disk. Above a limiting alpha-angle, the exit will be at the disk bottom-surface.

Alpha-angle-modeling is designed to identify the disk-thickness and alpha-angles at which the channel bottom-opening will be at the bottom-, side-, or side+bottom of the disk.

The critical alpha-angle of the channel is given by equation (17). The efficiency of mixing/stirring may also be limited by the thickness of the Disk, $D_t$. A disk that is thinner than the critical thickness, $D_{T,cr}$ will be less efficient than a disk with a thickness equal or greater than $D_{T,cr}$ (equations (18) and (19)).

The length of the half-chord through the center of the channel-center, $L_c$, is given by equation (16), where R is the disk radius and $R_H$ is the distance from the disk center to the chord. The channel length, I, is given by equation (17), where $D_t$ is the thickness of the disk and a is the drill angle.

$$L_c=\sqrt{R^2-R_H^2} \tag{16}$$

$$I=D_T*ctg\alpha \tag{17}$$

$$D_{T,cr}=I*\sin\alpha \tag{18}$$

$$\Delta D=D_T-D_{T,cr} \tag{19}$$

This limits the range of angles, since angles that are too flat may penetrate at the side of the disk instead of at the bottom. If ΔD in Equation (19) is larger than zero, the channel will open at the bottom-surface. If ΔD is negative, part or all of the channel-opening will be through the disk-rim.

Another enhancement of the channel flow-rate may be achieved by widening its opening. This extension of the entrance to the channel opening will be referred to as 'scoop'. Varying the beta-angle allows to direct the flow-direction at the outlet of the channel.

Scoop-Feeding

Initially, the stirrer was modeled with the channels starting at the surface and ending at the opposite surface. The opening-area of the channel, A, was given using a circular opening (equation (19)). It is known that the opening can be widened by adding 'scoops' to the input openings and varying the feeding rate of the channel.

For the stirrers and mixers, scooping increases by modifying the circular opening area of a channel to an ellipse. The opening area of the elliptic opening is determined by the drill-diameter and -angle. The contribution of the scoop-factor, $f_{la}$, for the elliptic long axes is determined by the alpha and beta drill angles as given in equation (20). It is dependent on the channel diameter, $R_d$, and the drill angle (alpha). The height of the elliptic feed area, $f_{la}$, is given in (equation (20)), and the width of the channel diameter, d. The scoop-area is given by the half-axes of the ellipse, f/2 and d/2 (equation (21)). The diameter the smaller axis is equal to the diameter of the channel, $D_h$.

$$f_{circ} = R_h^2\pi \tag{20}$$

$$f_{1,a} = \frac{d}{\cos(\alpha)} \tag{21}$$

$$\text{elliptic scoop-area} = f = \frac{\pi * f_{1a} * d_h}{4} \tag{22}$$

$$A = f * \pi R_h^2 \tag{23}$$

If a scoop-feed is included in the disks, the pumping rate equations have to be modified by replacing the right side of equation (21) with the applied opening area and its geometry.

Controlled Dilution (Stirrer and Mixer)

In many cases, the reactor-content needs to be changed by adding solutions of reactive other or materials. The addition rate of solutions must frequently be controlled to control the rate of interaction with the reactor content. The presented mixer design is well designed for this purpose (equations (24) and (25)).

The dilution ratio is defined as the diluted output concentration relative reactant input concentration, $C_{out}/C_{in}$.

The dilution factor is defined as the ratio of input to output concentration $C_{in}/C_{out}$. The dilution ratio and dilution factors depend on the input pumping rate, $Q_R$ and the pumping rate of the mixer, $Q_M$. The dilution ratio of reactants is defined by equation (24):

$$\text{Dilution-Ratio} = \frac{C_{Out}}{C_{In}} = \left[\frac{Q_R}{(n_i/N)*Q_H + Q_R}\right] \tag{24}$$

And the reactant dilution factor can be defined by equation (25):

$$\text{Dilution-Factor} = \frac{C_{In}}{C_{Out}} = \left[\frac{(n_i/N)*Q_H + Q_R}{Q_R}\right] \tag{25}$$

Figure 9:
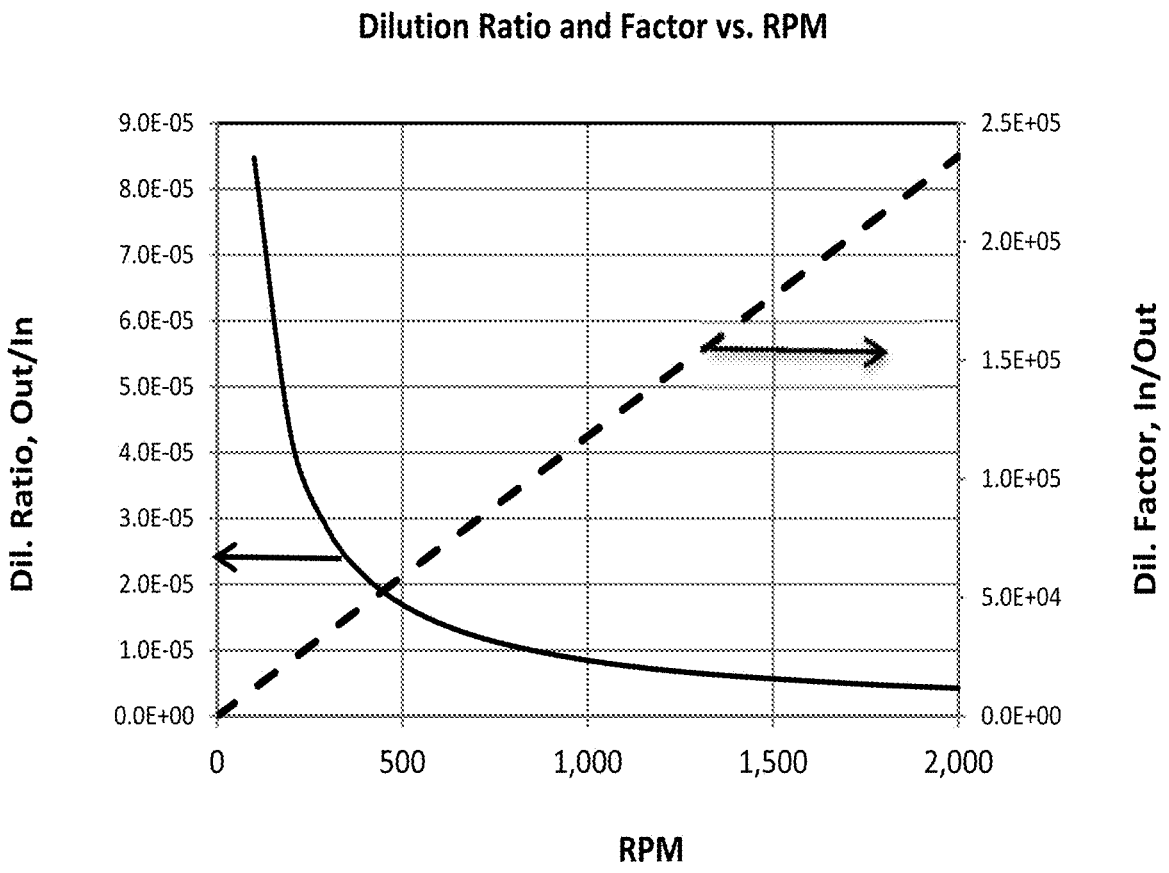
FIG. 9 depicts a graph of dilution ratios for an exemplary example of the present invention.

Dilution ratio (23) and dilution factor (24) as a function of mixing-rate (RPM) are plotted in FIG. 9 for a representative mixing example.

Reaction Control in Controlled Continuous Reactors (Mixer)

Besides the standard control variables, reactions within continuous reactors are affected by the special flow-controls and mixing events within the continuous reactors.

The precise addition of reacting solutions to the reactor content allows for precisely controlling the rate of interaction with the reactor content. The presented mixer design is well designed for this purpose (equations (24) and (25)).

In another preferred embodiment of the present invention, channels cut through a disk may be impregnated with a catalyst which further allows for increased control of reaction rates in a reactor and the flow of the desired ingredients is readily controllable as has been demonstrated. One may use any one or more of the means for impregnating a catalyst disclosed in U.S. Pat. No. 9,919,293 (catalyst for mild-hydrocracking of residual oil), U.S. Pat. No. 9,975,767 (catalyst arrangement), U.S. Pat. No. 9,981,252 (catalyst preparation method), and the like. The entire disclosure of each of these United States patents is hereby incorporated by reference into this specification.

Energy Consumption and Thrust

The energy requirement necessary to achieve a desired degree of mixing may be calculated for the devices of the present invention by the following formulas. These will allow a user skilled in the art to determine the appropriate rotation rate required to reach a desired pumping rate. The following formulas are scaled to the SI measurement convention but as those skilled in the art are aware could be readily scaled to other measurement systems by use of the appropriate conversion values which are widely known.

$$\text{Energy Consumption } W = \frac{F_M * v_s^2}{2}\left[\text{Watt} = \frac{1.0}{2}\frac{\text{kg}}{\text{s}} * \left(\frac{\text{m}}{\text{s}}\right)^2\right] \tag{26}$$

where $$F_M = 39.5 * R * r^2 * RPS * \rho\left[\frac{\text{kg}}{\text{sec}}\right] \tag{27}$$

where $$v_s = 2R * \pi * RPS \Big/ \eta\left[\frac{\text{m}}{\text{s}}\right] \tag{28}$$

$$W(\text{Mixer})\ W = n_i * F_M * v_s^2/2\ \ [\text{Watt}] \tag{29}$$

$$W(\text{Stirrer})\ W = n_s * F_M * v_s^2/2\ \ [\text{Watt}] \tag{30}$$

$$\text{HP HP} = W/776\ \ [\text{HP}] \tag{31}$$

Equations (29) to (31) may be useful if a stirrer or mixer of the current invention is considered for the function as a marine-propeller.

Figure 10:
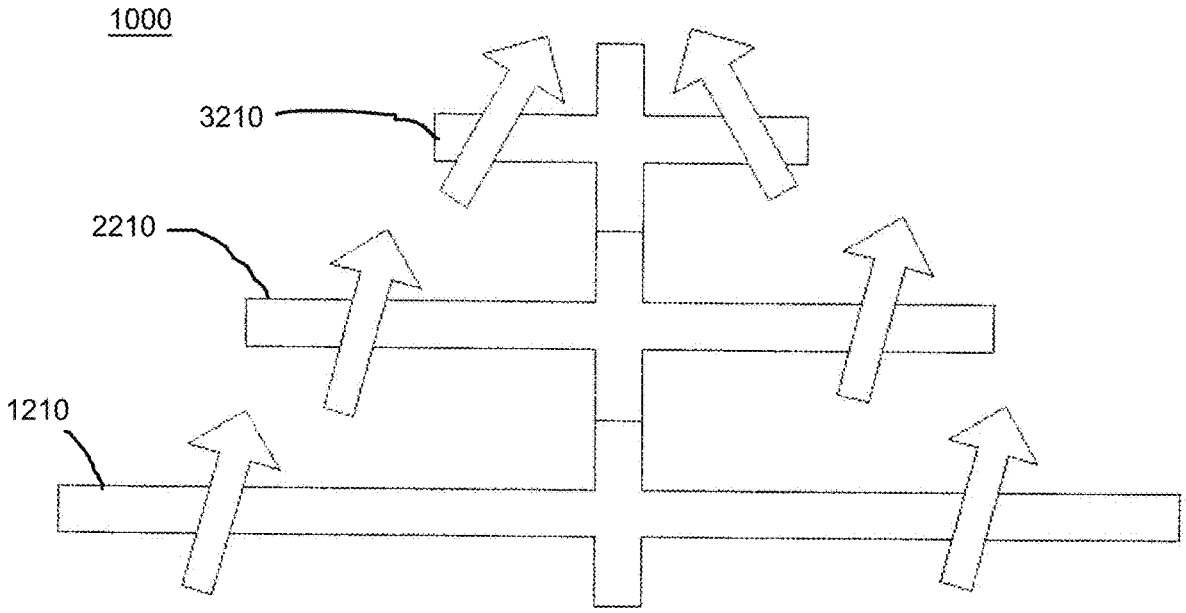
FIG. 10 depicts a representative example of a profile view of a multidisc stirrer of the present invention.
Figure 11:
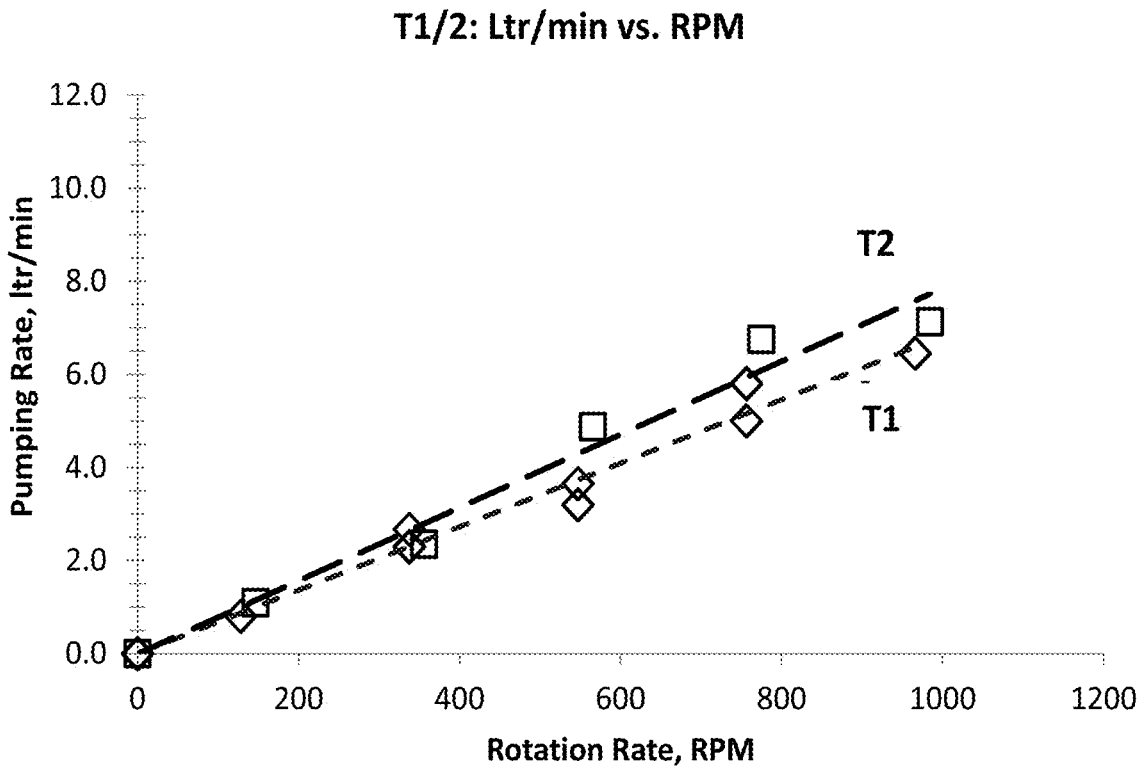
Figure 12:
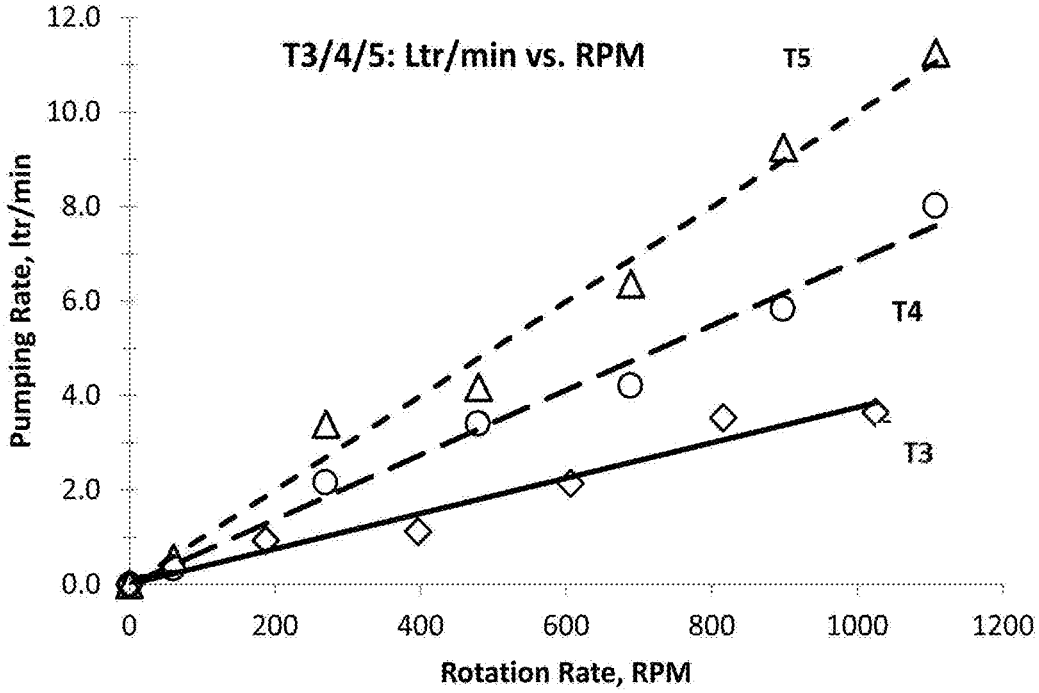
Figure 13:
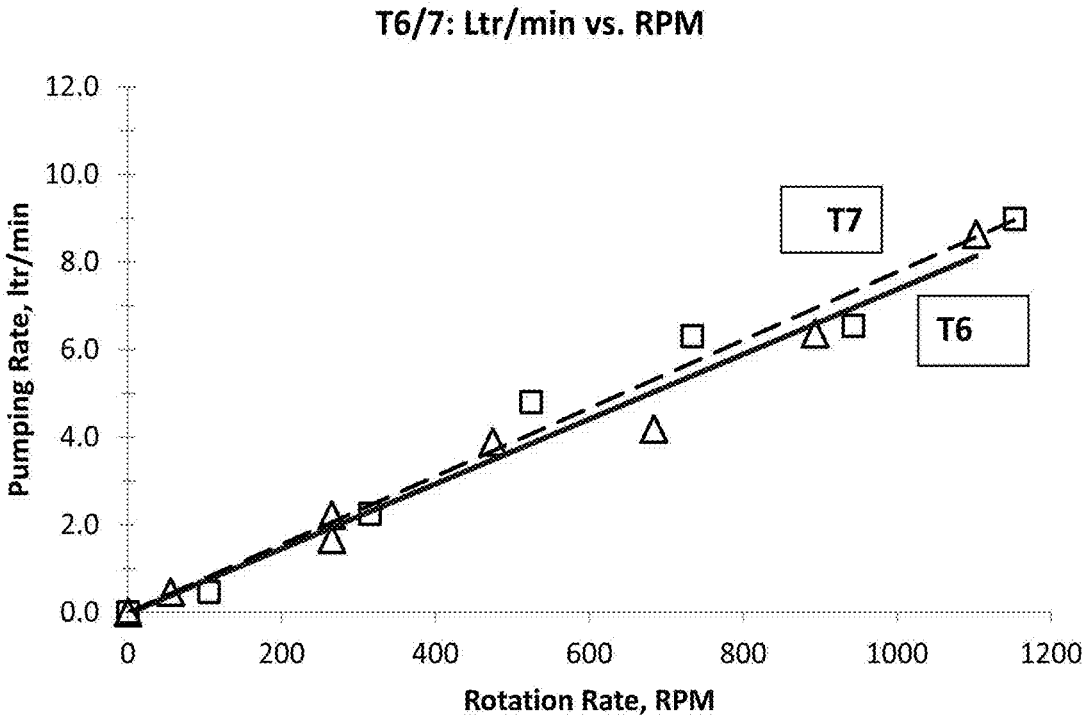
Figure 14:
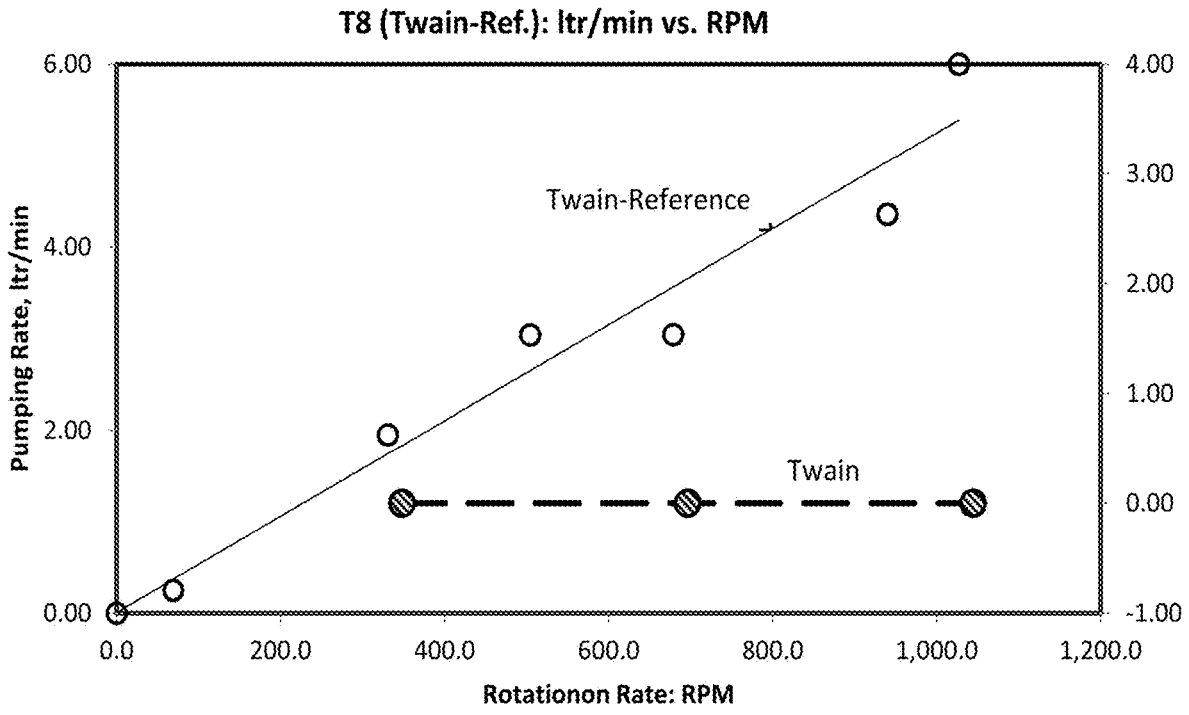

Referring to FIG. 10, a representative multidisc stirrer 1000 comprising three disks is shown. As is clearly depicted (though not necessarily to scale) the disks of the stirrer may each have a diameter that is different than the other disk diameters. Disk 1210 has a larger diameter than disk 2210 which has a larger diameter than disk 3210. In this particular case, the flow from all three disks is considered anti-stirring (the flow of material is from below each disk through the disk and exits above each disk. This feature of allowing the disk diameters to vary allows for specific tailoring of the precise flow rates through the stirrer. Notice that all three disks of the current example are parallel to each other.

Representative Examples of Stirrers and Mixers:

Several representative though non-exhaustive examples of the pumping rates of stirrers and mixers in use are presented below in FIGS. 11-15. Disks were cut out of 1.25 cm inch thick polyvinylchloride (PVC) sheets using a 14.6 cm hole-saw. Other methods to craft the disks such as laser controlled saws and drills or 3 dimensional printing which provide for precise dimensioning of disk size and channel arrangement may also be used to manufacture the disks. For experiments T1-T7, five channels (holes) were drilled into the disks at 45 deg. The channels were separated by 72 degrees on a common radius. In the center of each disk, a vertical hole was drilled for a 0.953 cm diameter drill-shaft.

For the Twain-reference experiment (T8), six channels were drilled at 60 degree radial separation and pumping rates were determined. For the Twain-design, the six channels are arranged in three pairs, where one channel pumps bottom-to-top, and the other top-to-bottom.

Experimental Design and measured pumping Rates

| Disk-Reference | Channel - Distance centimeters | Channel-Diameter centimeters | Measured Pumping-Rate at 1000 RPM liter/minute |
|---|---|---|---|
| T1 | 2.54 | 0.64 | 4.82 |
| T2 | 2.54 | 1.28 | 8.51 |
| T3 | 4.45 | 0.64 | 2.84 |
| T4 | 4.45 | 0.95 | 5.78 |

-continued

Experimental Design and measured pumping Rates

| Disk-Reference | Channel - Distance centimeters | Channel-Diameter centimeters | Measured Pumping-Rate at 1000 RPM liter/minute |
|---|---|---|---|
| T5 | 4.45 | 1.28 | 8.51 |
| T6 | 6.35 | 0.64 | 6.52 |
| T7 | 6.35 | 1.28 | 6.99 |
| T8 | 4.45 | 0.80 | 5.20 |

Figure 16:
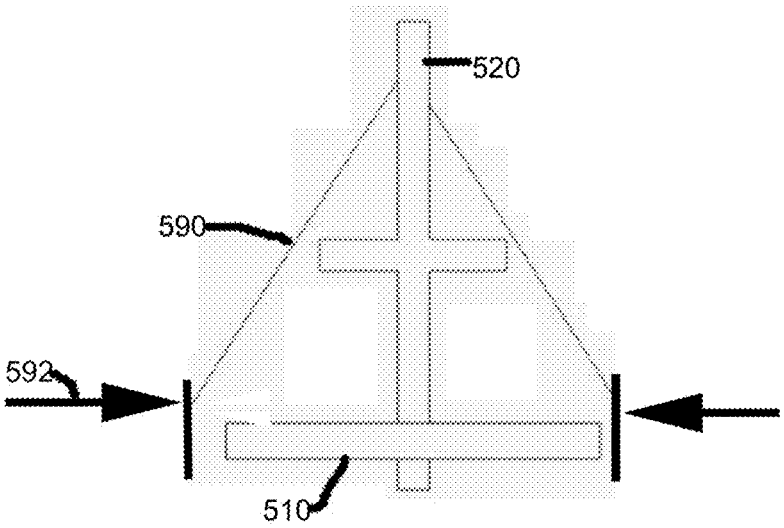
FIG. 16 depicts a representative example of a mixer with a baffle via a cavitation reducing cone of the present invention.

T8: Twain-Reference: 6 channels; others: 5 channels
Channel-Distance: distance of channel center from the shaft-center FIG. 16 depicts a representative example of a mixer of the present invention which includes a conical baffle 590 around a central mixer shaft 520. The conical baffle 590 prevents the formation of a vortex from the liquid surface along the mixer shaft 520 as liquid is drawn toward the rotating mixer. The mixer shaft 590 may be slid into the inverted neck of the conical funnel 520 with the funnel 520 affixed to the shaft 590 via readily available means such as with a hose clamp, a set screw, or the like. The preferred extent of the baffle above the mixer is such that the maximum baffle diameter 592 is about equivalent to or greater than the disk 510 diameter. In another preferred embodiment, not depicted, the baffle could be attached through readily available means to the wall of the reaction vessel.

Figure 17:
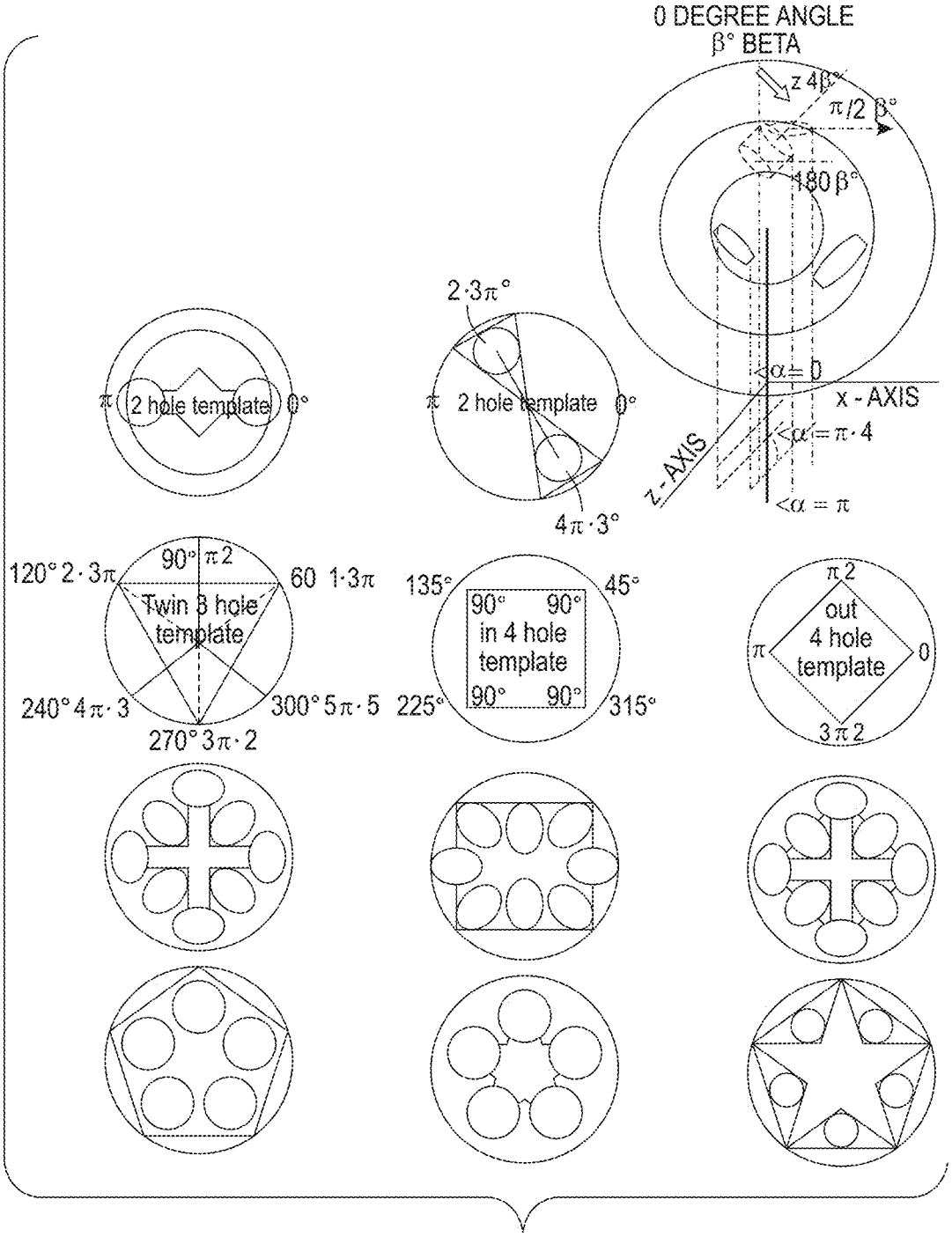
FIG. 17 depicts representative preferred hole configurations for the present invention.

Additional preferential channel geometries of the present invention are presented in FIG. 17. Though there are several geometric channel configurations presented in FIG. 17 the geometric configurations are by no means to be considered exhaustive of the possible channel configurations.

Although several embodiments of the present invention, methods to use said, and its advantages have been described in detail, it should be understood that various changes, substitutions and alterations can be made herein without departing from the spirit and scope of the invention as defined by the appended claims. The various embodiments used to describe the principles of the present invention are by way of illustration only and should not be construed in any way to limit the scope of the invention. Those skilled in the art will understand that the principles of the present invention may be implemented in any suitably arranged stirring or mixing system.

We claim:

1. A stirrer for precisely metering desired ingredients for dilution comprising at least one rotating disk and a central shaft and means for rotating said central shaft;

wherein the rotating disk is mounted to the central shaft;

said central shaft passing through the center of the rotating disk;

and the rotating disk has a top face and a bottom face and at least one channel is cut through the disk; wherein said at least one channel cut through the disk can be deemed to pass through the disk at an alpha angle wherein said alpha angle is measured between a ray on the plane of the surface of the disk and a second ray along the channel penetration through the disk and a projection of the channel penetration through the disk projected onto the surface of the disk can be deemed to pass through the disk at a beta angle wherein said beta angle is measured between a ray originating from the center of the disk along the tangent at a particular distance from the center of the disk and a ray along the channel penetration projection upon the surface of the disk; wherein the at least one channel penetration is precisely located and dimensioned to allow for precise calculation and measurement of flow through said channel according to the equations $Q_h = C_A * 4\pi^2 r^2 * R * N$ [$cm^3$/min] wherein $Q_h$ represents the pumping rate of the disk, $C_A$ represents the reactant concentration, r represents the disk radius, R represents the distance from the disk center, and N represents the disk rotation rate [$cm^3$/min] and $$A = \frac{\pi * f_{ia} * d_h}{4}; * \pi R_h^2$$

wherein A represents the opening-area of the channel, $f_{ia}$ represents the contribution of the scoop-factor, $d_h$ represents the diameter of the channel, and $R_h$ represents the radius of channel; and wherein the alpha angle and beta angle of each channel are determined to precisely meter the desired ingredients flow rates through the stirrer; wherein the disk may be rotated in either a clockwise or counterclockwise direction while still precisely measuring the flow through each said channel.

2. The stirrer of claim 1 wherein each of the at least one channels cut through the disk are cut non-perpendicularly through the disk.

3. The stirrer of claim 1 wherein each of the at least one channels cut through the disk are cut at an alpha angle of between about 45 and 90 degrees.

4. The stirrer of claim 3 wherein each of the at least one channels cut through the disk are cut at a beta angle of between about 0 and 30 degrees.

5. The stirrer of claim 3 wherein each of the at least one channels cut through the disk are cut at a beta angle of between about −30 and 0 degrees.

6. The stirrer of claim 3 wherein each of the at least one channels cut through the disk are cut at a beta angle of between about −30 and 30 degrees.

7. The stirrer of claim 3 further comprising a baffle.

8. The stirrer of claim 7 wherein said baffle further comprises a conical structure.

9. A mixer for precisely metering desired ingredients for mixing comprising at least two rotating disks and a central shaft and means for rotating said central shaft;

wherein each of the at least two rotating disks are i-s mounted to the central shaft;

said central shaft passing through the center of each of the at least two rotating disks;

and each of the at least two rotating disks has a top face and a bottom face and at least one channel is cut through each of the at least two rotating disks; wherein said at least one channel cut through each of the at least two rotating disks can be deemed to pass through the disk at an alpha angle wherein said alpha angle is measured between a ray on the plane of the surface of the disk and a second ray along the channel penetration through the disk and a projection of the channel penetration through the disk projected onto the surface of the disk can be deemed to pass through the disk at a beta angle wherein said beta angle is measured between a ray originating from the center of the disk along the tangent at a particular distance from the center of the disk and a ray along the channel penetration projection upon the surface of the disk; wherein the each at least one channel penetration through each disk is precisely located and dimensioned to allow for precise calculation and measurement of flow through said channel according to the equations $Q_h = C_A * 4\pi^2 r^2 * R * N$ [$cm^3$/min] wherein $Q_h$ represents the pumping rate of the disk, $C_A$ represents the reactant concentration, r represents the disk radius, R represents the distance from the disk center, and N represents the disk rotation rate [$cm^3$/min] and $$A = \frac{\pi * f_{ia} * d_h}{4}; * \pi R_h^2$$

$*\pi R_h^2$ wherein A represents the opening-area of the channel, $f_{ia}$ represents the contribution of the scoop-factor, $d_h$ represents the diameter of the channel, and $R_h$ represents the radius of channel; and wherein the alpha angle and beta angle of each channel are determined to precisely meter the desired ingredients flow rates through the mixer wherein either or both of the at least two disks may be rotated in either a clockwise or counterclockwise direction while still precisely measuring the flow through each said channel.

10. The mixer of claim 9 wherein the channels cut through each disk are cut non-perpendicularly through the disk.

11. The mixer of claim 9 wherein the channels cut through each disk are cut at an alpha angle of between about 45 and 90 degrees.

12. The mixer of claim 11 wherein the channels cut through each disk are cut at a beta angle of between about 0 and 30 degrees.

13. The mixer of claim 9 wherein the channels cut through each disk are cut at a beta angle of between about −30 and 0 degrees.

14. The mixer of claim 9 wherein the channels cut through each disk are cut at a beta angle of between about −30 and 30 degrees.

15. The mixer of claim 9 wherein each of the channels cut through each disk are cut at varying distances from the central shaft.

16. The mixer of claim 15 wherein the beta angle of each of the channels is unique.

17. The mixer of claim 15 wherein the alpha angle of each of the channels is unique.

18. The mixer of claim 15 further comprising a baffle.

19. The mixer of claim 18 wherein said baffle further comprises a conical structure.

20. The mixer of claim 9 wherein each of the channels cut through each disk take the configuration of a slot and wherein each slot comprises an inner surface wherein the inner surface of each slot is impregnated with a catalyst.

* * * * *